United States Patent [19]

Samuel

[11] 4,452,573

[45] Jun. 5, 1984

[54] VARIABLE PILOT CHEMICAL PUMP

[75] Inventor: William H. Samuel, Weatherby Lake, Mo.

[73] Assignee: Western Chemical Pumps, Inc., Kansas City, Mo.

[21] Appl. No.: 349,973

[22] Filed: Feb. 18, 1982

[51] Int. Cl.[3] ..... F04B 17/00

[52] U.S. Cl. ..... 417/401; 91/271; 91/306; 91/313

[58] Field of Search ..... 417/401; 91/305, 306, 91/313, 271

[56] References Cited

U.S. PATENT DOCUMENTS

| | | | |
|---|---|---|---|
| 2,018,215 | 10/1935 | Lausen . | |
| 2,139,101 | 9/1936 | Spencer . | |
| 3,282,167 | 11/1966 | McKenzie | 91/306 |
| 3,387,563 | 6/1968 | Williams . | |
| 3,618,468 | 11/1971 | Gardner et al. | 91/306 X |
| 3,814,548 | 6/1974 | Rupp | 417/395 |
| 3,963,383 | 6/1976 | Hill | 417/401 |
| 4,104,008 | 8/1978 | Hoffman et al. | 417/401 X |
| 4,329,123 | 5/1982 | Kawabata et al. | 91/306 X |

OTHER PUBLICATIONS

Exhibit A–Promotional material entitled–CHEMICAL INJECTION PUMP FROM LINC LIQUID LEVEL ELECTRONICS INC.

Exhibit B–Bulletin 178—3A from Williams Instrument Company, Inc. entitled OSCILLAMATIC CHEMICAL INJECTOR.

Exhibit C–Promotional material showing Arrow B+A 12 Series Chemical Pump Untitled.

Exhibit D–Product Catalogue from Western Chemical Pumps Inc. Showing Pump Models DFF, LD, MA, MT, MAS, MTS–A, MTS–A, MTS–B, MTS–C and MH.

*Primary Examiner*—Leonard E. Smith

*Attorney, Agent, or Firm*—D. A. N. Chase; Michael Yakimo, Jr.

[57] ABSTRACT

A chemical pump actuator utilizes a variable pilot for operation of the piston power unit and an attached chemical injector. The pilot structure includes a pair of valve assemblies for regulating the flow of a power fluid into and from the piston cylinder. Pressurization and depressurization of the diaphragmmatic pilot, as regulated by a control fluid flow independent of the power fluid flow, operates the power fluid inlet and outlet valve assemblies. This pressurization and depressurization of the pilot is regulated by control fluid inlet and outlet valve assemblies, these assemblies being cam actuated by the piston upon completion of the power and return strokes. Exhaust of the power fluid from the cylinder is regulated by a throttle assembly with the length of the stroke of the piston determined by a stroke control assembly. Accordingly, the piston cyclic rate and stroke can be independently adjusted presenting a pump actuator capable of a finely tuned control of the chemical injector attached thereto.

15 Claims, 9 Drawing Figures

Fig. 1.
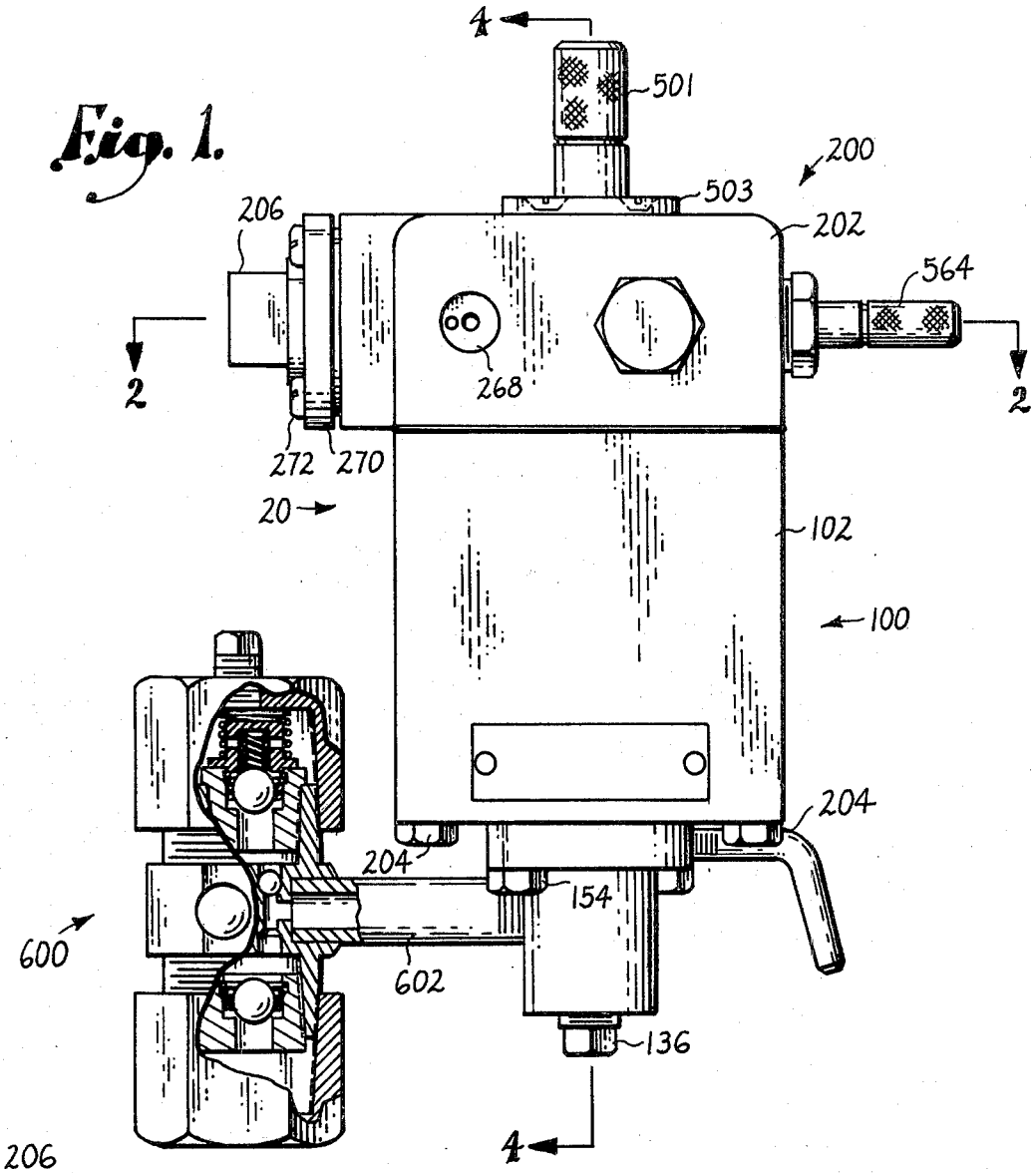
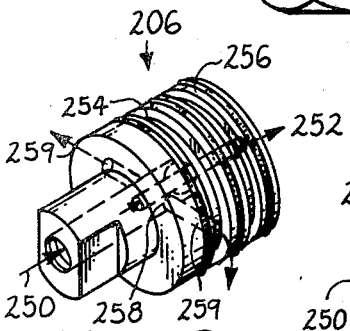
Fig. 9.
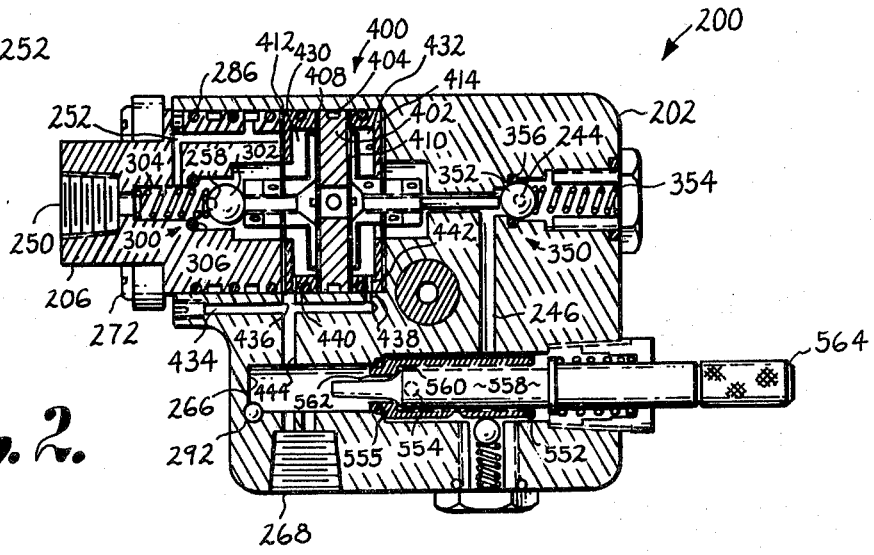
Fig. 2.

VARIABLE PILOT CHEMICAL PUMP

BACKGROUND OF THE INVENTION

This invention relates to a pump actuator and more particularly to a pump actuator utilizing a novel variable pilot mechanism operably responsive to a control fluid flow which effectively regulates the delivery of an independent power fluid to a piston cylinder for cyclic operation of the piston therein.

Chemical injection pumps are used to introduce small, measured quantities of a chemical additive into a primary fluid flow line for admixture with the primary fluid, such chemicals including demulsifiers, methanol, corrosion inhibitors, etc. In general, these pumps are both controlled and operated by a single fluid flow to pressurize and depressurize a piston and cylinder assembly so as to move the operating piston through its power stroke upon cylinder pressurization and allow the piston return stroke upon cylinder depressurization. In one prior pump design, the cylinder pressure is fed back to a diaphragm-controlled valve arrangement to provide a fluid oscillator that controls the flow of fluid to and from the cylinder.

Although the oscillator-type pump is effective, the range and precision of adjustment of the cyclic rate of the piston are limited. Also, pumps of this type appear to be properly functioning even though the operating piston, due to malfunction, is not moving through its cycle.

Accordingly, recognizing this latter trait but more importantly to provide a pump which more effectively controls the cyclic rate and stroke of the operating piston, I have invented a chemical pump that does not utilize fluid pressure feedback to control the operating piston. My device utilizes a variable pilot mechanism having a pair of pressure responsive diaphragms forming a control fluid chamber therebetween. The diaphragms are movably responsive to chamber pressurization/depressurization as provided by a control fluid flow independent of a power fluid flow routed to and from the cylinder of the operating piston. This chamber pressure modification is provided by control fluid inlet and outlet valve assemblies which are actuated upon the completion of the power and return strokes of the operating piston. Upon diaphragm response, corresponding to the pressure modification of the pilot chamber, the cylinder inlet/outlet valves are alternately opened and closed to control the power fluid flow into and out of the cylinder. Accordingly, I have provided a pump actuator utilizing a variable pilot mechanism operably independent of the cylinder pressurization, which allows for an effective, finely tuned control of the cyclic rate of the operating piston. I have also provided means for adjusting the length of the power stroke therein independent of this cyclic rate control. Furthermore, if a malfunction occurs that causes the piston to stall, my pump will not falsely indicate that it is functioning normally.

It is therefore a general object of this invention to provide a pump actuator for controlling an injector device attached thereto, which utilizes a variable pilot mechanism, as operated by a control fluid, to regulate an independent power fluid flow to a power unit cylinder so as to effect the power and return strokes of the power unit piston.

It is another general object of this invention to provide a pump utilizing a variable pilot mechanism, as aforesaid, which is operably independent of the pressure of the power cylinder.

It is still a further object of this invention to provide a pump actuator utilizing a variable pilot mechanism, as aforesaid, which includes a diaphragmmatic pressure chamber therein for operating cylinder power fluid inlet and exhaust valve assemblies in response to control fluid pressurization and depressurization of said pressure chamber.

Another object of this invention is to provide such a variable pilot mechanism having associated control fluid inlet and outlet valve assemblies, operable in a timed relationship with the completion of the strokes of the operating piston so as to pressurize and depressurize the pressure chamber.

A particular object of this invention is to provide inlet and outlet valve assemblies for the control fluid which are cam actuated upon piston contact during the power and return strokes.

A further particular object of this invention is to provide a pump actuator of this type in which the length of the power and return strokes of the piston may be readily controlled.

Still another particular object of this invention is to provide a throttle assembly, independent of the stroke control, for regulating the rate of discharge of the power fluid from the cylinder to control the cyclic rate of the operating piston therein.

Another object of this invention is to provide a pump actuator, as aforesaid, which is lightweight, compact and easily transported by virtue of having pilot and power unit housings with control and power fluid conduits wholly located therein so as to present an internal network of functional power and control fluid paths.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 1 is an elevational view showing the pump actuator with a chemical injector device attached thereto.

FIG. 2 is a horizontal sectional view taken along line 2—2 in FIG. 1 and showing therein the variable pilot mechanism.

FIG. 9 is a perspective view of the fluid manifold providing for control and power fluid flows to the associated conduits in the pilot housing.

DESCRIPTION OF THE PREFERRED EMBODIMENT

Referring more particularly to the drawings, the pump actuator 20 generally comprises a power unit 100 and a pilot mechanism 200 which pneumatically controls the operation of the power unit 100 so as to operate an associated injector pump 600 of conventional design.

Figure 4:
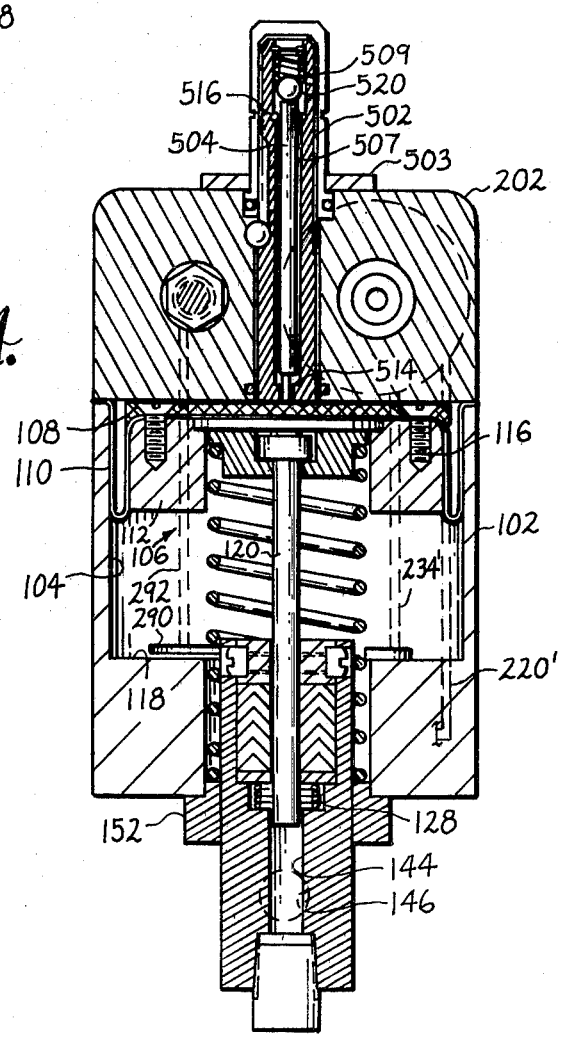
FIG. 4 is a vertical sectional view, taken along line 4—4 in FIG. 1, showing the power unit and the stroke control assembly with the control fluid exhaust assembly therein.
Figure 6:
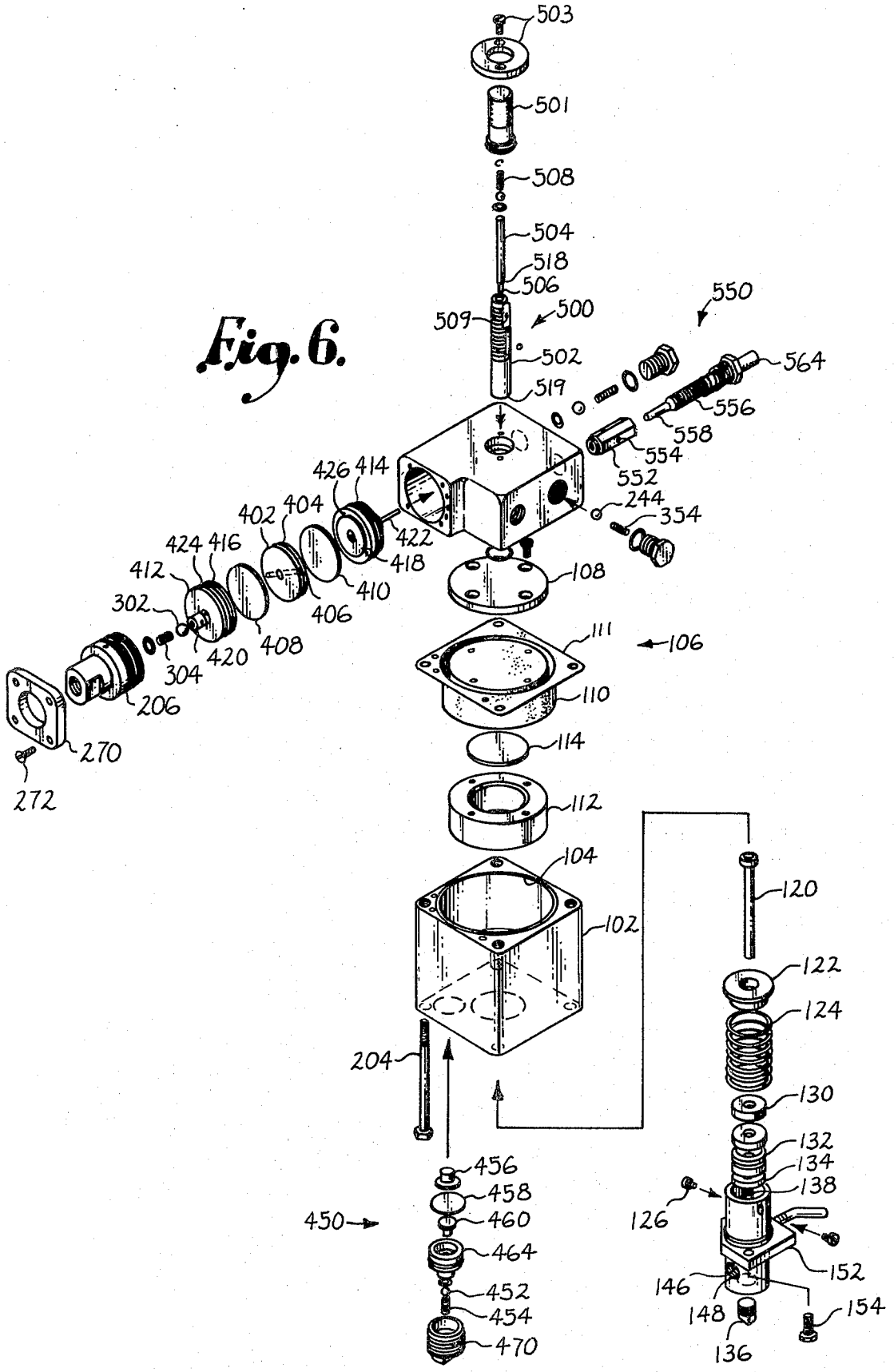
FIG. 6 is an exploded view of the pump actuator proper.

The power unit 100 is shown in FIGS. 4 and 6 and comprises a cylinder block/housing 102 presenting an operating cylinder 104 which receives a piston assembly 106 therein. The piston assembly 106 includes a bonnet 108 positioned atop a flexible motive diaphragm 110 with a motive piston proper 112, including separable head 114, underlying the bonnet 108 and diaphragm 110. The bonnet 108 is secured to the piston proper 112 by screws 116 with the diaphragm 110 sandwiched therebetween. A planar mounting surface 111 of diaphragm 110 is interposed between housings 102 and 202 upon joinder thereof. Diaphragm 110 thus presents a motive fluid seal to the operating cylinder 104 during operation of the piston assembly 106.

Piston rod 120 is operably associated with the piston 112 by means of engagement with a cup 122 nested in the piston return spring 124. The free end of rod 120 extends beyond the lower cylinder wall 118 and into a stuffing box assembly 126. Piston rod 120 terminates within a downwardly depending fluid bore 144. A preload spring 138 within chamber 128 provides an initial bias to gland 134.

The stuffing box 126 utilizes a buttress 130, chevron seals 132 and gland 134 about the piston rod 120 for preclusion of fluid leakage therein. Plug 136 seals the terminus of the bore 144. Set screws 140 extend through the box 126 in a bearing relationship against the seals for maintenance of the seals therein. The stuffing box 126 is secured to the housing 102 by means of a mounting plate 152/screw 154 combination.

Laterally extending from depending bore 144 is a threaded bore 146 presenting aperture 148 at the terminus thereof. The injector pump proper 600 is placed in communication with bore 146 by functional engagement of the exteriorly threaded conduit 602 with this lateral bore 146.

The pilot mechanism 200 is contained within a housing 202 mounted atop the power unit housing 102 by means of four elongated bolts 204. Thus mounted, a number of power and control fluid flow conduits or paths are established between the respective housings 202 and 102 including the cylinder 104 therein.

Figure 7:
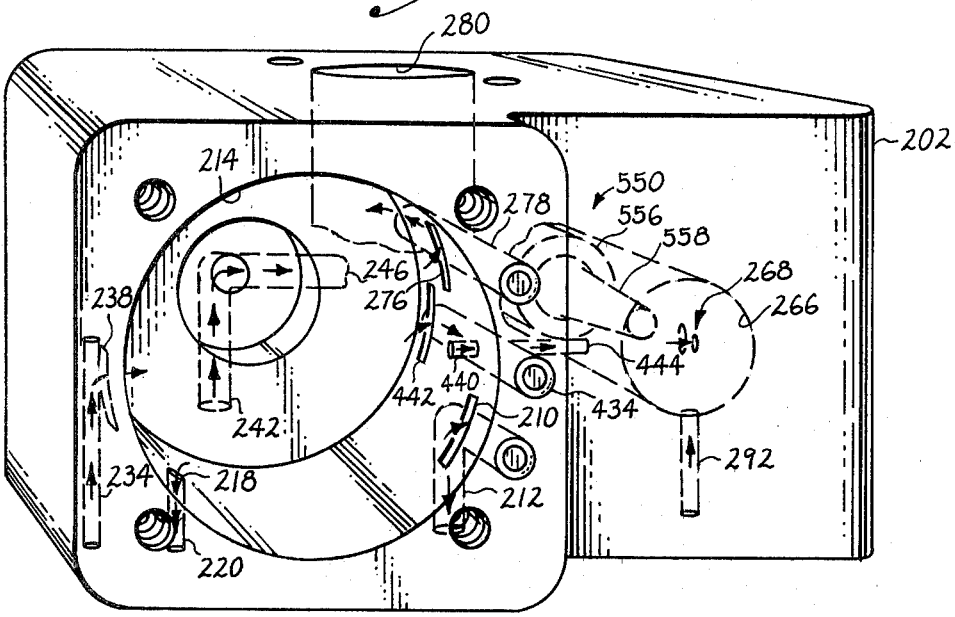
FIG. 7 is a perspective view of the pilot housing, on an enlarged scale, showing the power and control fluid conduits bored therein.
Figure 8:
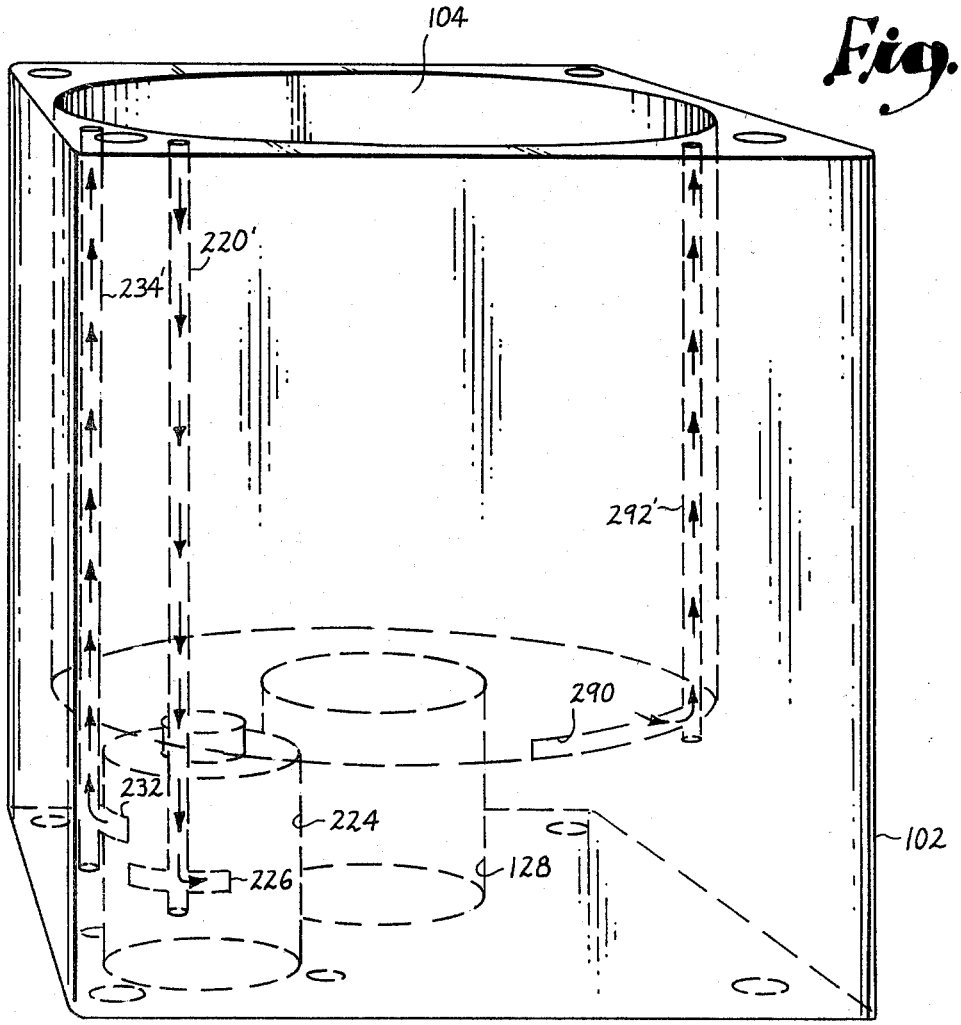
FIG. 8 is a perspective view of the power unit housing, on an enlarged scale, showing the power and control fluid conduits bored therein.

As best seen in FIG. 7 a first power fluid slot 210 is provided in the face of central bore 214 in communication with a downwardly depending power fluid bore 212 extending therebeyond. The opposed end of this bore 212 is in direct communication with the piston cylinder 104. This communication presents a power fluid flow path, designated as 216, from the power fluid slot 210, through the pilot housing 202 and into the piston cylinder 104.

Immediately beyond the slot 210 is an aperture 218 presenting a downwardly depending control fluid bore 220. This bore 220 is in registration with bore 220' vertically extending through the housing 102. This bore 220' is in communication with a control fluid valve assembly chamber 224 via input slot 226 in the chamber 224 face. Thus, a control fluid flow path or conduit designated as 228, is provided.

A return control fluid flow path 230, relative to chamber 224, is provided by a return slot 232 in chamber 224 in communication with a return bore 234' in housing 102 and with bore 234 in housing 202. This path 230 terminates in the central bore 214 at slot 238.

A power fluid exhaust path designated as 240 for discharge of the power fluid from the cylinder 104 is presented by an exhaust bore 242 extending through the housing 202 and having one end in communication with piston cylinder 104. The other end of this power fluid, exhaust bore 242 is defined by a valve controlled aperture 244. A branch 246 of exhaust path 240 is in a valve controlled communication with the exhaust aperture 244 in a manner to be subsequently described. The power fluid exhaust branch 246 is in further communication with a central exhaust conduit 266 having an air throttle assembly 550 therein. This assembly 550 regulates the rate of exhaust fluid discharge from exhaust branch 246 into the central exhaust conduit 266 for ultimate discharge out exhaust port 268.

Having presented the above-discussed separate flow paths for the control and power fluid flows, I provide a pilot manifold 206 which conveys a pressurized fluid from a single fluid source 284 to these respective fluid flow paths. As shown in FIG. 9, this manifold 206 is generally circular in configuration for insertion into the pilot central bore 214 and includes a central pressure inlet bore 250 extending centrally therethrough. Manifold 206 is maintained in position by a screw 272 attachment of a manifold mounting plate 270 to the housing 202. In communication with this manifold bore 250 is a manifold control fluid conduit 252 in further communication with a manifold control fluid annular ring 256. Upon connection of manifold 206 to the pressurized fluid source 284 the fluid flows to the annular ring 256 via the conduit 252. This annular ring 256 cooperates with the face of bore 214 to present an annular chamber in communication with the control fluid aperture 218.

Power fluid apertures 258 in manifold bore 250 are in fluid communication with the annular ring 254 via radial bores 259. This annular ring 254 cooperates with the face of bore 214 to present an annular chamber in communication with the power fluid slot 210. O-rings 286 provide their functional seal between the manifold 206 and central bore 214 and are likewise designated throughout this specification and in the drawings.

As shown in FIG. 2, first and second power fluid inlet and outlet valve assemblies 300 and 350 are provided to regulate the power fluid flow through the power fluid inlet 258 into cylinder 104 and from cylinder 104 to outlet 244. Each assembly 300, 350 comprises a spring 304, 354 biased ball valve 302, 352. As shown in FIG. 2, ball 302 is biased out of registration with its ball seat 306 with the ball 352 being biased into contact with its respective seat 356. This first bias displaces the ball 302 out of registration with the power fluid aperture 258 of manifold 206 and ball 352 into registration with the power fluid exhaust aperture 244. This first bias is as shown in FIG. 2 with the respective valve assemblies 300, 350 allowing a power fluid flow through power fluid flow inlet path 216 to cylinder 104 while precluding a power fluid flow through the power fluid exhaust path 240.

To provide for an alternating opening and closing of the respective power fluid apertures 258, 244, I have provided a control fluid chamber assembly 400 which is operably responsive to the control fluid flow therein. As best shown in FIG. 6, the assembly 400 comprises a control fluid chamber member 402 having an annular peripheral control fluid channel 404 in control fluid communication with an open center by means of a radial bore 406 extending therethrough.

On opposed sides of the diaphragm chamber member 402 are holding diaphragms 408 and 410 which flex in response to pressurization and depressurization of the pilot chamber which, at minimum volume, is defined by the open center of member 402.

In association with these pressure responsive diaphragm members 408, 410 and respectively adjacent thereto are cylindrical valve seats 412 and 414 each having a valve member therein consisting of a valve face 416, 418 and connected valve stems 420, 422 abutting the respective ball valves 302, 352. Thus, the motive response of the diaphragm members are transmitted to the ball valves 302, 352. Equator diaphragms 424, 426 are positioned along the back walls of the respective valve seats 412, 414 to form equator chambers 430, 432.

This pilot assembly 400 is placed within the bore 214 of the pilot housing 202. As best seen in FIG. 2, placement of the assembly 400 therein presents an annular fluid chamber (channel 404) in communication with the control fluid return slot 238 (FIG. 7), this slot defining the terminus of the return control fluid flow path 230.

Each equator chamber 430, 432 is in fluid communication with the ambient air by means of an ambient air conduit 434 through housing 202 and having branches therein 436, 438 in communication with equator chambers 430, 432 through bores 440, 442 in the valve seat members 412, 414. This ambient air conduit 434 has an exhaust branch 444 in communication with the central exhaust conduit 266. These equator chambers 430, 432 being pressurized to atmosphere, provide reference pressure against diaphragms 408, 410. Thus, the direction of diaphragm 408, 410 movement is subject to the modification of the pilot chamber pressure therebetween.

Accordingly, pressurization of the chamber causes opposed lateral movement of the diaphragms 408, 410 which is transmitted along the valve stems 420, 422 to the ball valve members 302, 352. Thus, a second bias overcoming the first spring bias on the ball valves is provided so as to move the ball valve 302 into registration with power fluid inlet aperture 258 and ball valve 352 out of registration with the power fluid exhaust aperture 244.

Figure 5:
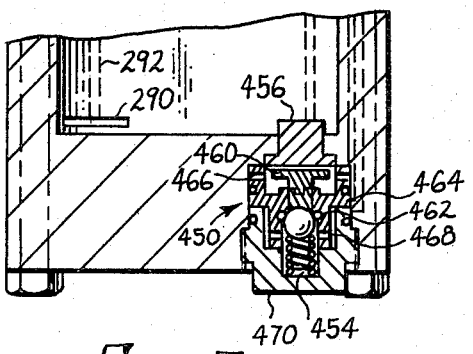
FIG. 5 is a fragmentary, vertical sectional view, taken from the opposed side of FIG. 4, showing the control fluid intake valve assembly.

Regulation of the control fluid flow to the pilot chamber is provided by a control fluid valve assembly 450. This assembly is best seen in FIGS. 5 and 6 and comprises a ball 452 valve being spring 454 biased into a ball seat 462/valve closure position. The assembly 450 further includes a cam member 456 projecting into the piston cylinder 104 at a position corresponding to the terminus of the piston power stroke. Underlying the cam 456 is a push rod 460 with loading diaphragm 458 therebetween. A surrounding valve body 464 is positioned within the chamber 224 and held thereat by a cap 470. Within valve body 464 are upper and lower slots 466 and 468 in communication with the control fluid inlet 226 and outlet 232 slots of the chamber 224.

The cam actuated valve assembly 450 as interposed in the control fluid flow paths 228 and 230, regulates the delivery of the control fluid to the pressure chamber 402. As discussed the control fluid is routed from the pressure source to the inlet path 228 via the manifold 206. This control fluid flow stops at the biased closed valve 450. Upon completion of the power stroke of the piston, the cam 456 is contacted which drives the push rod 460 to displace ball 452 from its seat. Upon such displacement the lower slot 226 is placed in fluid communication with the upper annular slot 232 which communicates the control fluid flow paths 228 and 230. When these flow paths are thus joined, pressurization of the pilot chamber results.

Depressurization of the pilot chamber is through a control fluid exhaust path 274 as defined by a control fluid exhaust conduit 278 extending between slot 276 in central bore 214 and the stroke control bore 280 in housing 202. Positioned within the stroke control bore 280 is a stroke control assembly 500. The stroke control assembly 500 comprises an elongated, externally threaded sleeve 502 adjustable along the stroke control bore 280 by rotation of internally threaded knob 501. This knob rotation adjusts the degree of extension of the lower end of the sleeve 502 beyond the housing 202 and into the cylinder 104 to present a stop for the piston. Retaining ring 503 is provided to maintain the assembly 500 therein. No extension of this stop sleeve 502 is shown in FIG. 2 allowing for a maximum stroke of the piston. Selectable extension of sleeve 502 into the cylinder 104 limits the length of the return stroke of the piston as desired and thus the length of the subsequent piston power stroke.

As shown in FIG. 4, the pilot chamber exhaust valve assembly is cooperably housed within the sleeve 502. This assembly comprises an elongated stem member 504 extending through an exhaust chamber 507 which is the bore of the sleeve 502. Stem 504 has a lower free end of a reduced diameter to present a shoulder 518 engaging a seat 514 which precludes the stem from sliding through the outlet orifice 519. Atop the valve stem 504 is a spring 508 biased ball member 520 urged into a seated position with the valve seat 516. Upon pressurization of the chamber 402 the control fluid flows through a limited portion of the control fluid flow exhaust path 274 via slot 276 and conduit 278 and attempts to enter the exhaust chamber 507 via aperture 509. However, the valve 520 being biased to a valve closure position by the respective seating of the shoulder 518 and ball 520 precludes the flow of the control fluid therein thus allowing the pressurization of the pilot chamber. Upon the piston approaching the terminus of its return stroke, as shown in FIG. 4, the piston bonnet 108 contacts the projecting cam 506 member which unseats the shoulder 518 and ball 520. Only then is the control fluid allowed to flow from and through the exhaust chamber 507 and into cylinder 104 where it commingles with the power fluid being exhausted therein. This flow depressurizes the pilot chamber, such depressurization occurring only at the terminus of the piston return stroke due to the relative positioning of the stroke control and exhaust valve assemblies.

The exhaust of the power fluid from the cylinder exhaust fluid path 240 and into the exhaust branch 246 is controlled by the power fluid exhaust valve assembly 350. The rate of discharge of the power exhaust fluid from branch 246 into the central exhaust conduit 266 is controlled by an air throttle assembly 550.

This assembly 550 comprises a throttle housing block 552 positioned in the central exhaust conduit 266. The exhaust fluid from the branch 246 is routed from the central conduit 266 surrounding the housing 552 and through orifice 554 in housing 552. A throttle valve 556 having a tapered stem 558 variously engages the seat 560 of the throttle block 552. Upon a full seating of this stem 558, no power fluid exhaust can pass through outlet 562 and into the unthrottled portion of conduit 266 which includes the terminal exhaust port 268 therein. A full throttling is provided by a gross displacement of the whole throttle 556 from its seated position in a manner which displaces the block 552 from seat 555 in central conduit 266. This throttle 556 movement/housing 552 displacement allows for a rapid flow of the power exhaust fluid around the throttle block 552 for subsequent discharge out the terminal exhaust port 268. A fine tuning adjustment is provided by rotation of the throttle valve 556 by knob 564. This rotation moves the throttle along the interiorly threaded block 552 which variously adjusts the degree of seating of the tapered stem 558 with the seat 560. Thus, a finely tuned air bleed of the exhaust fluid from branch 246, through orifice 554 and out the throttle housing outlet 562 is provided.

This throttle assembly 550 regulates the rate of flow of the power fluid exhaust from the cylinder 104. This regulation allows the speed of the spring biased piston return stroke to be adjusted which ultimately adjusts the overall cyclic rate of the piston through its power and return strokes.

Also, as shown in FIG. 4, a slot 290 is provided at the bottom of the cylinder 104. Extending between this slot 290 and the central exhaust conduit 266 is a bore 292. This arrangement provides a pressure relief on the front side of the piston 112 during the power stroke thereof.

OPERATION

Figure 3:
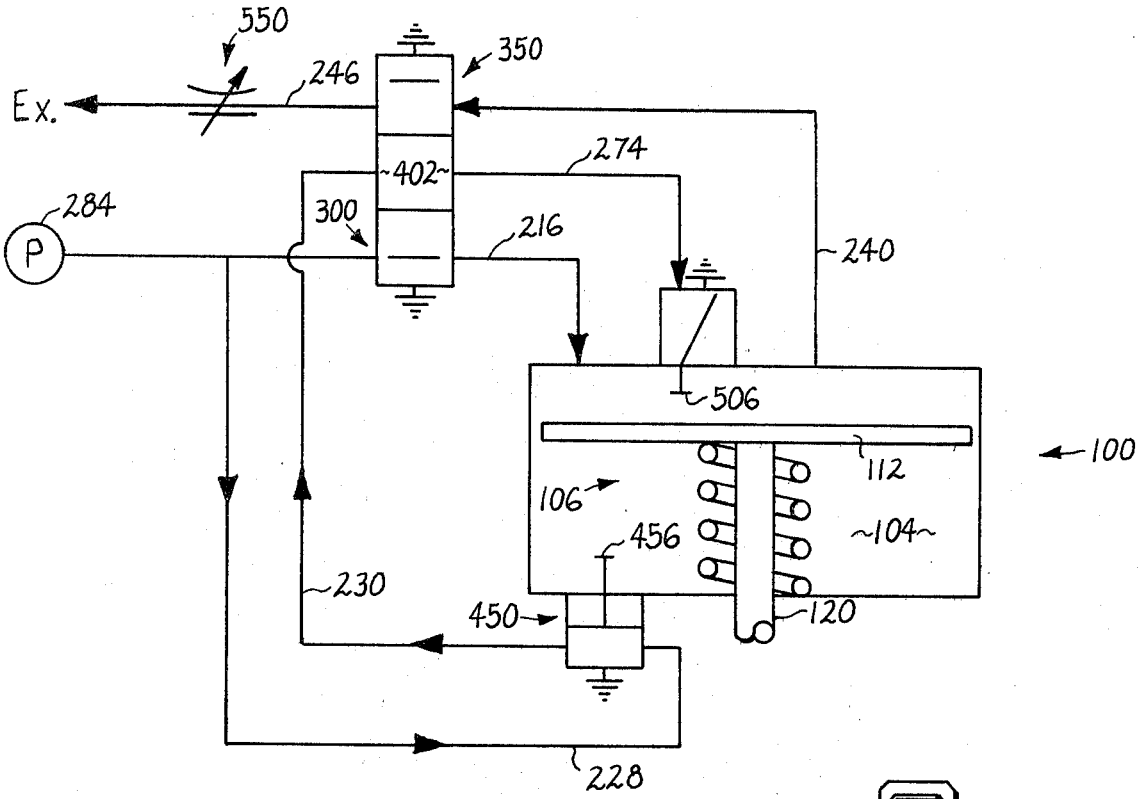
FIG. 3 is a diagrammatic view showing the variable pilot, power unit, associated valve assemblies and the associated power and control fluid flow paths.

Operation of the pump actuator is as diagrammatically shown in FIG. 3, the power stroke of the piston 112 therein shown in progress.

As shown the fluid flow from the single pressure source 284 enters the manifold 206 and is split therein into a power fluid and a control fluid. The control fluid flows through the central bore 250 of the manifold 206, through the control fluid conduit 252 and about the annular control fluid ring 256 forming a chamber with the walls of the pilot bore 214. This control fluid chamber directs the control fluid to the aperture 218 and along the control fluid inlet path 228.

As shown in FIG. 5, the control fluid chamber valve assembly 450 is in a closed position precluding the control fluid from flowing into the control fluid return path 230 and into the pilot chamber. This preclusion of the control fluid flow prevents pressurization of the pilot chamber. Accordingly, the spring bias 304, 354 of the first and second ball valve assemblies 300 and 350 moves the ball member 302 out of registration with the power fluid aperture 258 and the ball member 352 into registration with exhaust aperture 244. Thus, the flow from the pressure source goes through the open aperture 258 and about the power fluid chamber 254 as presented by the annular ring 254/bore 214 wall cooperation. This power fluid chamber 254 is in communication with the power fluid slot 210 and conduit 212 causing the power fluid to enter the cylinder 104. Upon entry into the cylinder 104 the power fluid causes a pressure buildup therein, due to closure of the power fluid exhaust path 240 and thus effects the power stroke of the piston.

The power stroke of the piston advances the piston rod 120 along bore 144 causing a pressure buildup therein which is communicated to the injector pump 600 attached thereto. This plunger action of the piston rod thus causes the injector 600 to perform its pumping operation and inject a predetermined amount of liquid chemical into the outlet line (not shown).

Upon completion of the power stroke, cam 456 is depressed causing the ball 452 to unseat, thus allowing the control fluid into path 230 which pressurizes the pilot chamber. This pressurization causes movement of the diaphragm members 408, 410 which is transmitted along the respective valve stems 420 and 422 to overcome the spring bias of the ball valve assemblies 300, 350. Thus, an overriding bias is applied which positions ball 302 in registration with the power fluid aperture 258 while ball 352 is moved out of registration with the exhaust aperture 244. Therefore, pressurization of the pilot chamber prevents power fluid from flowing into the cylinder 104 while allowing the power fluid to exhaust from the cylinder to permit the piston to execute its return stroke. This power fluid exhaust flow is regulated along branch 246 by throttle assembly 550 in a manner as described above.

The return stroke of the piston causes suction of the chemical into the bore 144 which is in communication with the attached injector pump 600. Upon completion of the return stroke of the piston, cam 506 is contacted allowing for depressurization of the pilot chamber in a manner as described above. Depressurization of the pilot chamber removes the overriding bias to return the valve assemblies to their FIG. 2 position for execution of the subsequent piston cycle.

It should be appreciated that the length and frequency of the power stroke of the piston are determined by adjustment of the stroke control 500 and throttle 550 assemblies. These piston operating parameters, as selected by the user, enable the amount of chemical additive to be injected into the primary line by the injector 600 to be precisely controlled.

It is to be understood that while certain forms of this invention have been illustrated and described, it is not limited thereto, except in so far as such limitations are included in the following claims.

Having then described the invention, what is claimed as new and desired to be secured by Letters Patent is:

1. A pump actuator comprising:

inlet means for receiving a fluid under pressure;

a power unit including a piston and cylinder with said piston executing a power stroke in response to flow of said fluid into said cylinder;

means for causing said piston to undergo a return stroke subsequent to said power stroke;

power fluid flow paths from said inlet means into said cylinder to effect said power stroke and from said cylinder to permit said return stroke upon flow of a power fluid respectively therethrough;

power fluid gate means for controlling the flow of said power fluid through said associated paths;

means responsive to first and second pressure stimuli for operating said power fluid gate means in a manner to cause said power fluid to alternately flow through said power fluid flow paths;

said gate means further comprising: a valve assembly including first and second movable gate elements associated with said respective power fluid paths; and means for transmitting the response of said operating means to said first and second pressure stimuli into movement of said gate elements into and out of said respective power fluid paths to alternate said power fluid flow into and from said cylinder corresponding to an alternating execution of said power and return strokes;

conduit means for establishing a control fluid flow path from said inlet means to said operating means independently of said power fluid flow paths;

control fluid valve means interposed in said conduit means and responsive to movement of said piston through one of said strokes for communicating said control fluid with said operating means to present said first stimulus thereto; and means responsive to movement of said piston through the other of said strokes to present said second stimulus thereto whereby to present said alternating power fluid flow for execution of said piston strokes at a controlled rate.

2. A pump actuator comprising:

inlet means for receiving a fluid under pressure;

a power unit including a piston and cylinder with said piston executing a power stroke in response to flow of said fluid into said cylinder;

means for causing said piston to undergo a return stroke subsequent to said power stroke;

pilot structure for establishing power fluid flow paths from said inlet means into said cylinder to effect said power stroke and from said cylinder to permit said return stroke;

pressure responsive means for operating said pilot structure to cause said piston to alternately execute said power and return strokes;

said pilot structure further comprising: a pilot valve assembly including first and second movable components associated with said respective power fluid paths; and means for transmitting the response of said operating means pressurization and depressurization into movement of said valve components into and out of said respective power fluid paths to alternate said power fluid flow into and from said cylinder corresponding to an alternating execution of said power and return strokes;

conduit means for establishing a control fluid flow path from said inlet means to said operating means independently of said power fluid flow paths into and from cylinder;

control fluid valve means interposed in said conduit means and responsive to movement of said piston through one of said strokes for communicating said control fluid with said operating means to pressurize the latter; and means responsive to movement of said piston through the other of said strokes for depressurizing said operating means, whereby the piston executes said power and return strokes at a controlled rate.

3. The device as claimed in claim 2, further comprising:

an exhaust conduit;

means for communicating said power fluid flow path from said cylinder and into said exhaust conduit;

a throttle assembly interposed in said exhaust conduit for regulating the rate of said power fluid flow exhaust from the cylinder whereby to control the allowable speed of said piston return stroke and the operating rate of said piston cycle.

4. The device as claimed in claim 2, wherein said means for depressurizing said operating means comprises:

a cam member having one end projected into said cylinder;

a control fluid exhaust conduit for establishing a control fluid flow exhaust path from said operating means;

a valve component, said piston contacting said cam member during one of said piston strokes to move said valve component out of said control fluid exhaust conduit to allow a control fluid flow from said operating means and said control fluid exhaust path;

bias means urging said valve component into said control fluid flow exhaust path during the other of said piston strokes for preclusion of said control fluid exhaust therethrough.

5. The pump actuator as claimed in claim 2, further comprising a pilot unit housing having said pilot structure, operating means and a first portion of said conduit means therein, and wherein said power unit includes a housing having said piston and cylinder, control fluid valve means, depressurizing means and a second portion of said conduit means therein, there being means joining said pilot unit and power unit housings together to present a unitary pump actuator body, and said housings having internal passageways presenting said power fluid and control fluid flow paths.

6. The device as claimed in claim 2, wherein said control fluid valve means comprises:

a cam member having one end projecting into said cylinder;

a valve component interposed in said conduit means for blocking said control fluid flow, said piston contacting said cam member during one of said piston strokes to cause said cam to move said valve member into a position allowing a control fluid flow; and bias means urging said control fluid valve component into said interposition in said conduit means during the other of said piston stroke whereby to provide an alternating control fluid flow corresponding to the strokes of said piston.

7. The device as claimed in claim 6, wherein said control fluid valve means further comprises:

a housing adjacent one end of said piston cylinder for containing said control fluid valve means therein;

means for communicating said cam member with said housing and said cylinder;

a segment of said control fluid flow path extending between said inlet means and said housing;

a segment of said control fluid flow path extending from said housing to said operating means, said piston contacting said cam member during one of said strokes in a manner to join said segments whereby to provide said control fluid flow.

8. The device as claimed in claim 2, further comprising means for establishing the length of one of said strokes of said piston and including a stop member selectably extensible into said cylinder for abutting the piston in a manner to define the terminus of one of said strokes.

9. The device as claimed in claim 8, further comprising trigger means for actuatihg said depressurizing means, said trigger means responsive to said abutment of said piston with said stop member to present a timed relationship between said operating means depressurization and the completion of one of said piston strokes.

10. The device as claimed in claim 2, wherein said transmission means comprises:

a first bias means responsive to said depressurization in a manner to urge one of said valve components into and the other of said valve components out of an associated power fluid path; and a second bias means responsive to said pressurization in a manner to urge said one valve component out of and said other valve component into said associated power fluid path.

11. The device as claimed in claim 10, wherein said first bias means comprises a spring member bearing against each valve component to present said first bias urging one of said valve components into and the other of said valve components out of the associated power fluid path.

12. The device as claimed in claim 11, wherein said second bias means comprises linkage means operably associated with said operating means and said valve components in a manner to translate said pressurization and depressurization of said operating means into a motive force along said linkage means whereby to present said second bias against said valve components in a manner to overcome said first bias thereon.

13. The device as claimed in claims 2 or 10, wherein said operating means comprises:

a diaphragm chamber in communication with said conduit means;

first and second diaphragm members forming opposed walls of said chamber and movably responsive to said chamber pressurization and depressurization to present said operating means pressure response.

14. The device as claimed in claim 13, wherein said operating means further comprises:

an equator chamber on the opposed sides of said chamber in a pressure bearing relationship therewith;

an inlet conduit for conveying a fluid flow to each equator chamber for pressurizing the same;

an exhaust conduit for venting said fluid from said equator chambers, said pressurized equator chambers urging each diaphragm member toward said diaphragm chamber with said exhausted equator chambers allowing movement of each diaphragm member away from said diaphragm chamber upon pressurization of the same.

15. The device as claimed in claim 14, wherein said equator fluid flow is the ambient air providing for a reference atmospheric pressure bearing against said chamber diaphragms.

* * * * *